US005575006A

United States Patent [19]

Wolfe

[11] Patent Number: 5,575,006

[45] Date of Patent: Nov. 19, 1996

[54] HOSPITAL PRIVACY GARMENT

[76] Inventor: Dorothy T. Wolfe, 3056 White Oak Dr., Cottonwood, Calif. 96022

[21] Appl. No.: 349,748

[22] Filed: Dec. 5, 1994

[51] Int. Cl.[6] ..... A41B 9/00

[52] U.S. Cl. ..... 2/114; 2/221

[58] Field of Search ..... 2/114, 69, 78.1, 2/78.2, 78.4, 80, 83, 227, 228, 238, 212, 213, 400, 402, 404, 405, 406, 407, 408, 70, 71, 72, 76, 220, 221, 237; 450/102–105

[56] References Cited

U.S. PATENT DOCUMENTS

| | | | |
|---|---|---|---|
| 579,145 | 3/1897 | Grean | 2/213 |
| 1,083,712 | 1/1914 | Uyeda . | |
| 1,807,908 | 6/1931 | Freed | 2/213 |
| 1,966,060 | 7/1934 | Cohen | 2/407 |
| 2,343,480 | 3/1944 | Sansom . | |
| 2,548,660 | 4/1951 | Feldman . | |
| 2,638,900 | 5/1953 | Gruenberg et al. . | |
| 2,825,906 | 3/1958 | Stumpf . | |
| 4,104,742 | 8/1978 | Rahaim . | |
| 4,106,125 | 8/1978 | Palumbo . | |
| 5,327,586 | 7/1994 | Evans et al. | 2/211 |

FOREIGN PATENT DOCUMENTS

| | | | |
|---|---|---|---|
| 532563 | 2/1922 | France | 2/72 |
| 1331157 | 5/1963 | France . | |

*Primary Examiner*—C. D. Crowder
*Assistant Examiner*—Gloria Hale
*Attorney, Agent, or Firm*—John P. O'Banion

[57] ABSTRACT

A hospital garment is disclosed which includes a waist encircling band, front and rear panels which depend therefrom, and reversible fasteners on the front and rear panels. The waist encircling band is reversibly attachable about the waist of a wearer using snap fasteners. Additional snap fasteners are located in the lower central portion of both the front and rear panels so that the front and rear panels fasten at the crotch of a wearer in a non-overlapping fashion, and leg holes are formed. When the garment is attached about the wearer's waist and fastened about the wearer's crotch, vertical slits are defined on the outside of the wearer's legs. Overlapping flaps are included on the rear and front panels to cover the vertical apertures. Tubing and wiring associated with medical treatment may be inserted through the front and rear panels at the point of fastening in the crotch portion, as well as through the slits in the outer leg portion of the garment, thus allowing access by hospital personnel without requiring removal of the garment.

12 Claims, 4 Drawing Sheets

HOSPITAL PRIVACY GARMENT

BACKGROUND OF THE INVENTION

1. Field of the Invention

This invention pertains generally to garments for covering the portion of a wearer's body from the waist down, and more particularly to a hospital garment of wrap-around type, having overlapping front and rear panels which reversibly fasten together at the crotch, and which includes vertically oriented slits along the leg portions covered by overlapping flaps.

2. Description of the Background Art

Several types of garments are known which utilize reversible fastening means in the waist and crotch portions. These garments generally are employed as pants which can reversibly convert to skirt-type garments, or as infant garments such as diaper arrangements.

For example, U.S. Pat. No. 4,106,125 discloses a convertible garment in which a skirt or dress garment is convertible into short pants by means of a concealed crotch panel with connecting means. U.S. Pat. No. 4,104,742 discloses a convertible garment which is interchangeable between pants and a skirt garment by means of a fastening hook and pile fabric fastener in the crotch portion. U.S. Pat. No. 2,825,906 discloses an infant's garment combining a panty with a skirt for baby girls, wherein a panty garment with side fastenings includes a pendant skin portion. U.S. Pat. No. 2,638,900 discloses a baby pants structure with overlapping reversibly attachable crotch portions. U.S. Pat. No. 2,548,660 discloses plastic pants for infants which includes overlapping reversibly attaching crotch parts which allow removal and changing of diapers. U.S. Pat. No. 2,343,480 discloses a combined and convertible skirt and bifurcated garment with a reversibly fastenable crotch element. U.S. Pat. No. 1,083,712 discloses wearing apparel with an appendage on a back portion which may be fastened to flies on a front portion. French No. 1,331,157 shows wrap around pants having a removable crotch strap and a pocket.

As can be seen therefore, a variety of garments with reversible waist and crotch fasteners for covering persons from the waist down have been previously developed. However, the aforementioned garments include deficiencies which make them unsuitable for use as modern hospital garments. For example, currently available garments generally have overlapping crotch flaps which do not easily allow passage of tubing related to patient treatment or wires and sensors related to monitoring of patients. Also, such garments do not include openings on the outside leg portions for insertion of tubes, wires or sensors from the side of the patient. Additionally, such garments do not allow facile access to the patient by physicians, nurses, or other health care personnel in the course of treating patients. Further, the garments described above are not easily placed on or removed from hospital patients with limited mobility, requiring substantial effort on the part of hospital personnel in changing garments on patients, and generally causing discomfort to the patients.

Thus, there is a need for a hospital garment with reversible waist and crotch fastening means which allows facile passage of tubing, wiring, sensors and the like through a fastenable crotch portion of the garment, as well as through the outer leg portions of the garment, so as to allow quick and easy access to the patient by health care personnel, and which can be quickly and easily placed on and removed from patients. The present invention satisfies these needs as well as others, and generally overcomes the deficiencies found in currently available garments.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention pertains to a hospital garment which has a fastenable crotch portion and overlapping side flaps along the outer leg portion thereof, which allows facile access of tubing and wires, which permits quick and easy access to a hospital patient by hospital personnel, and which is quickly and easily placed on and removed from hospital patients.

In general terms, the invention comprises a garment for covering the portion of the body from the waist down. The garment is of a wrap-around type, with elastic and a drawstring at the waist. Multiple snaps at the waist, in combination with the drawstring, allow the garment to be used with different waist sizes. In the crotch area, there are snaps to secure the front panel to the back so that leg holes are formed on each side. Each thusly formed leg portion includes vertically oriented slits on the outer portion thereof with overlapping flaps that provide both privacy and easy access for medical instrumentation or for examination of the patient.

By way of example and not of limitation, the garment includes an elastic waistband with a drawstring running therethrough and which is attachable about the waist of a wearer by conventional fastening means, which may comprise snap fasteners, buttons, zippers, fastening hook and pile fabric arrangements such as VELCRO® fasteners, and the like. Front and rear panels, made of a drapeable fabric or material, depend downward from the waistband. Similar fastening means are located in the lower central portion of both the front and rear panels so that the panels fasten at the crotch of a wearer in a non-overlapping fashion and, when fastened, establish leg holes which make the garment a pant-like structure. Alternatively, the crotch area fasteners could be left unfastened, thereby making the garment a skirt-like structure. The front and rear panels also include vertical apertures or slits in the area of the wearer's legs, and overlapping flaps which cover the slits.

The non-overlapping fastening of the front and rear panels at the crotch of the wearer allows tubing and wiring associated with treatment to be included between front and rear panels at the point of fastening. The vertical apertures along the outside of the wearer's legs similarly allow access by hospital personnel without requiring removal of the garment.

An object of the invention is to provide a hospital garment which allows inclusion of tubing and wiring related to patient treatment at the crotch portion of the garment.

Another object of the invention is to provide a hospital garment which allows inclusion of tubing and wiring related to patient treatment at the outside leg portion of the garment.

Another object of the invention is to provide a hospital garment which allows quick and easy access to the wearer by physicians and other health care personnel without requiring removal of the garment.

Another object of the invention is to provide a hospital garment which can quickly and easily be placed on and removed from hospital patients having limited mobility.

Further objects and advantages of the present invention will be brought out in the following portions of the specification, wherein the detailed description is for the purpose of fully disclosing the invention without placing limits thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
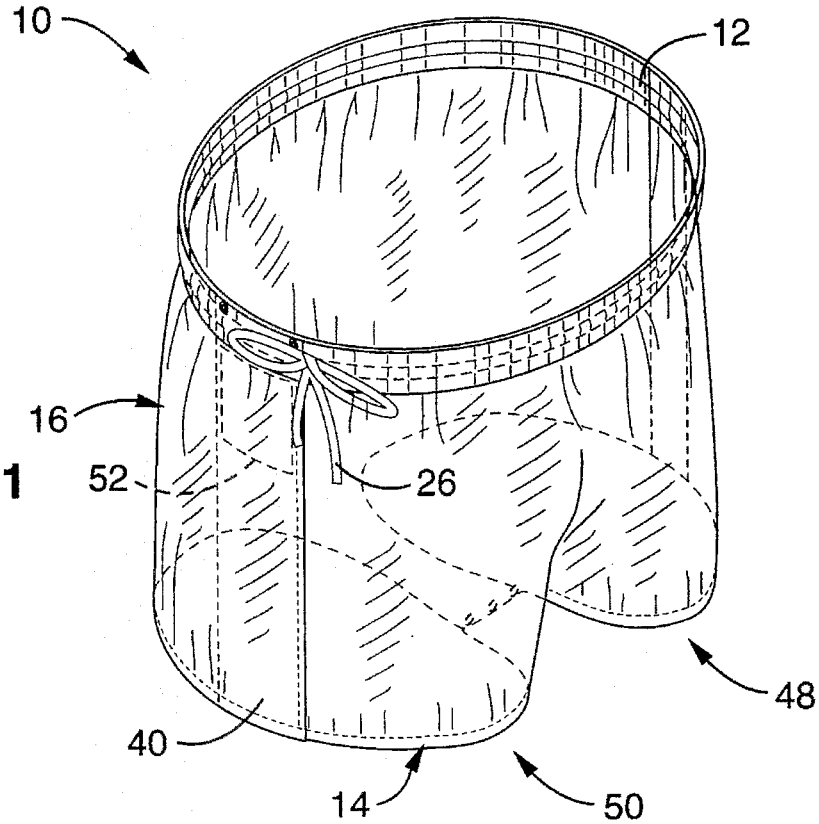
FIG. 1 is perspective view of a hospital garment in accordance with the present invention.

Referring more specifically to the drawings, for illustrative purposes the present invention is embodied in the garment generally shown in FIG. 1 through FIG. 6. It will be appreciated that the invention may vary as to configuration and as to details of the parts without departing from the basic concepts as disclosed herein.

Referring to FIG. 1 through FIG. 6, a hospital garment 10 in accordance with the present invention is shown. Garment 10 includes a waist encircling support means 12 which is preferably in the form of an elastic waistband or strap, but which may be made of a non-elastic material if desired. Depending downward from waist encircling support means 12 are a front panel member 14, and a rear panel member 16. Front 14 and rear 16 panel members are preferably made of fabric or sheet material which is drapeable.

Preferably, front panel member 14 includes a top end 18 and a bottom end 20, and rear panel member 16 includes a top end 22 and a bottom end 24. A channel (not shown) is preferably included through waistband 12 along the top ends 18 and 22 of front 14 and rear 16 panel members, respectively, through which a drawstring 26 or the like is contained.

Fastening means are included on front 14 and rear 16 panel members, preferably adjacent the bottom ends 20, 24. Generally, the fastening means is in the form of a plurality of snap fasteners 28*a*, 28*b*. Buttons, zippers, or fastening hook and pile fabric arrangements such as VELCRO® fasteners, are also possible fastening means.

Front panel member 14 preferably has a first edge 30 and a second edge 32, and rear panel member 16 preferably has a first edge 34 and a second edge 36. A first overlapping flap or clew 38 is included on rear panel member 16 adjacent to first edge 34, and a second overlapping flap or clew 40 is included on rear panel member 16 adjacent to second edge 36. Note that flap 38 is formed by the overlapping of front panel member 14 and rear panel member 16 at second edge 32 and first edge 34, respectively.

Garment 10 is worn by encircling waistband 12 around the waist of a wearer, and allowing front 14 and rear 16 panel members to depend downward therefrom, generally providing covering for the wearer from the waist downward. Front panel member 14 is adjusted so that it is generally positioned in front of the wearer, and rear panel member 16 is generally positioned so that it is in the rear of the wearer. Means for circumferentially adjusting the hospital garment 10 to the size of the waist of a wearer are included along front panel member top end 18 and rear panel member top end 22, preferably in the form of a plurality of snap fasteners 42*a*, 42*b*, which allow adjustment of the garment 10 to fit the waist size of the wearer. Additionally, drawstring 26 may be tightened about a wearer's waist and tied thereto and, if support means 12 includes elastic, the elastic will assist in adjusting the size of support means 12 to the wearer. Buttons, zippers, or fastening hook and pile fabric arrangements such as VELCRO® fasteners, are also contemplated as adjustment means. Alternatively, instead of support means 12 having separated ends which are joined together in an overlapping manner with snap fasteners 42*a*, 42*b* as described, support means 12 could be made continuous so as to make garment 10 a pull-on type.

Figure 2:
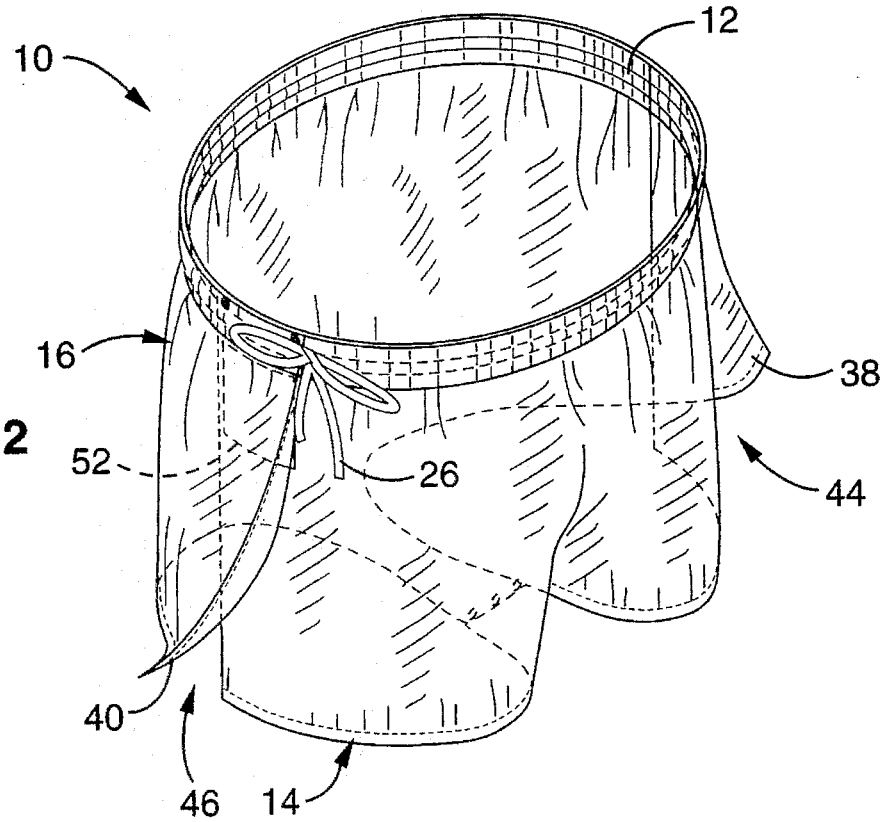
FIG. 2 is a perspective view of the hospital garment shown in FIG. 1 showing the overlapping leg flaps pulled away to reveal the vertically oriented slits in the outer leg portion of the garment.
Figure 3:
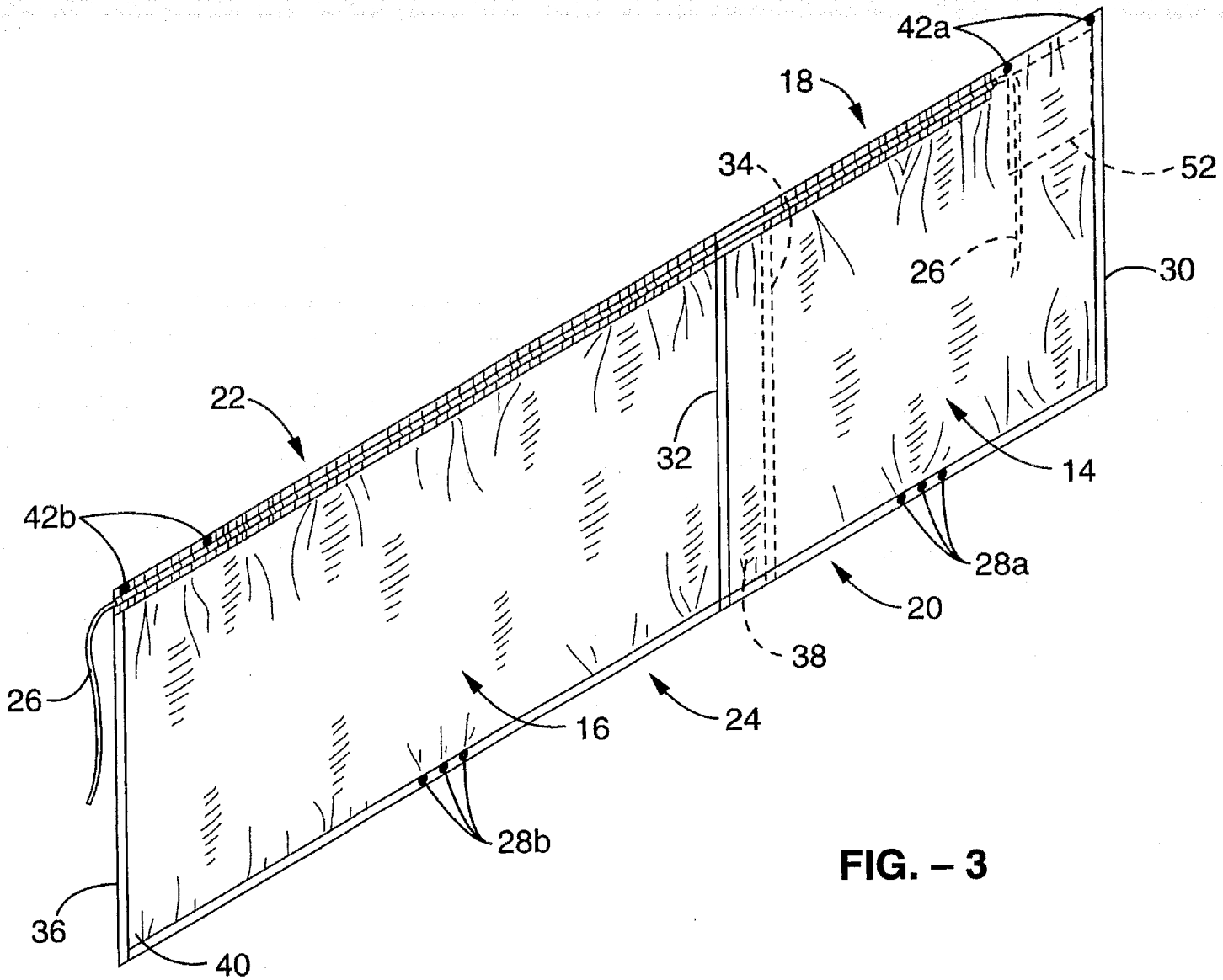
FIG. 3 is a perspective view of the hospital garment of FIG. 1 shown in its fully extended form.
Figure 4:
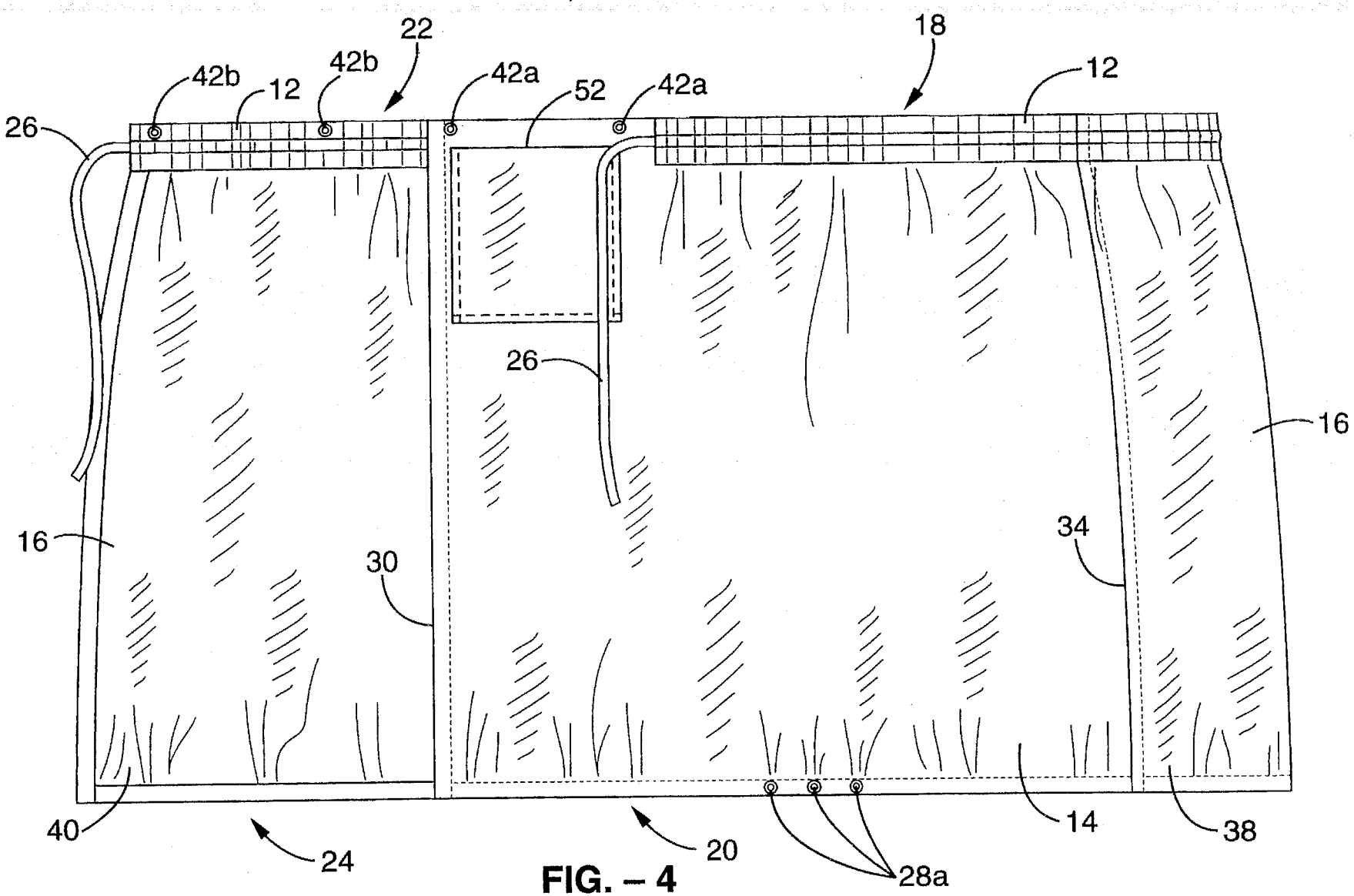
FIG. 4 is a front view of the hospital garment of FIG. 1 shown with the front and rear panels overlapping.
Figure 5:
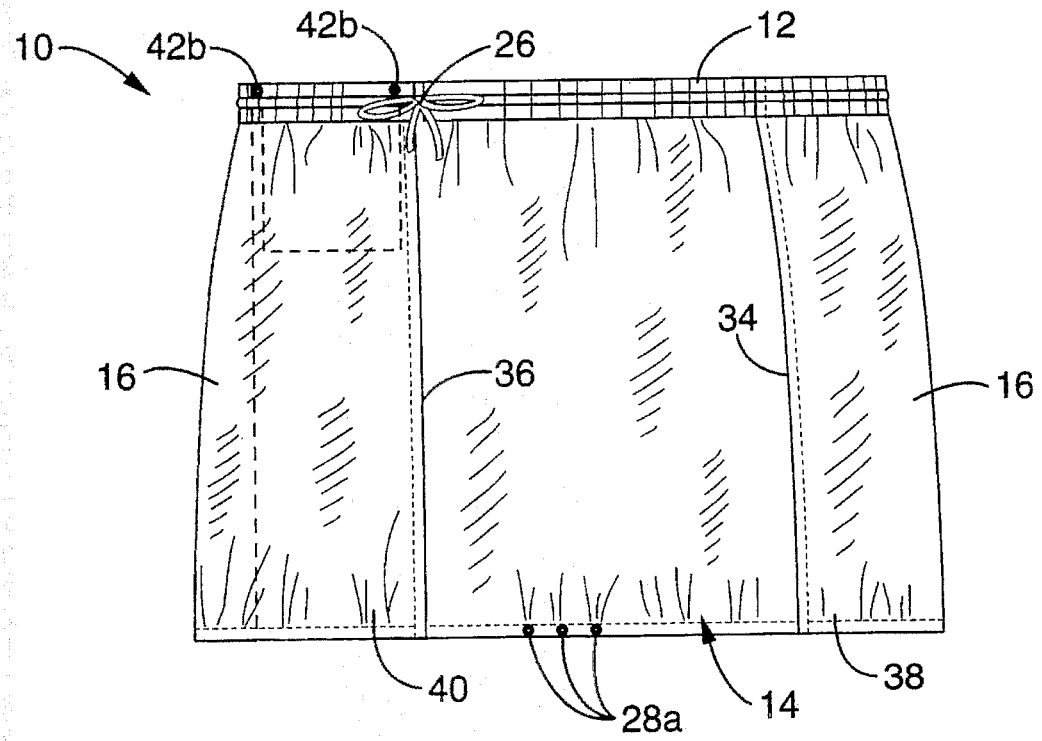
FIG. 5 is a front view of the hospital garment of FIG. 1.
Figure 6:
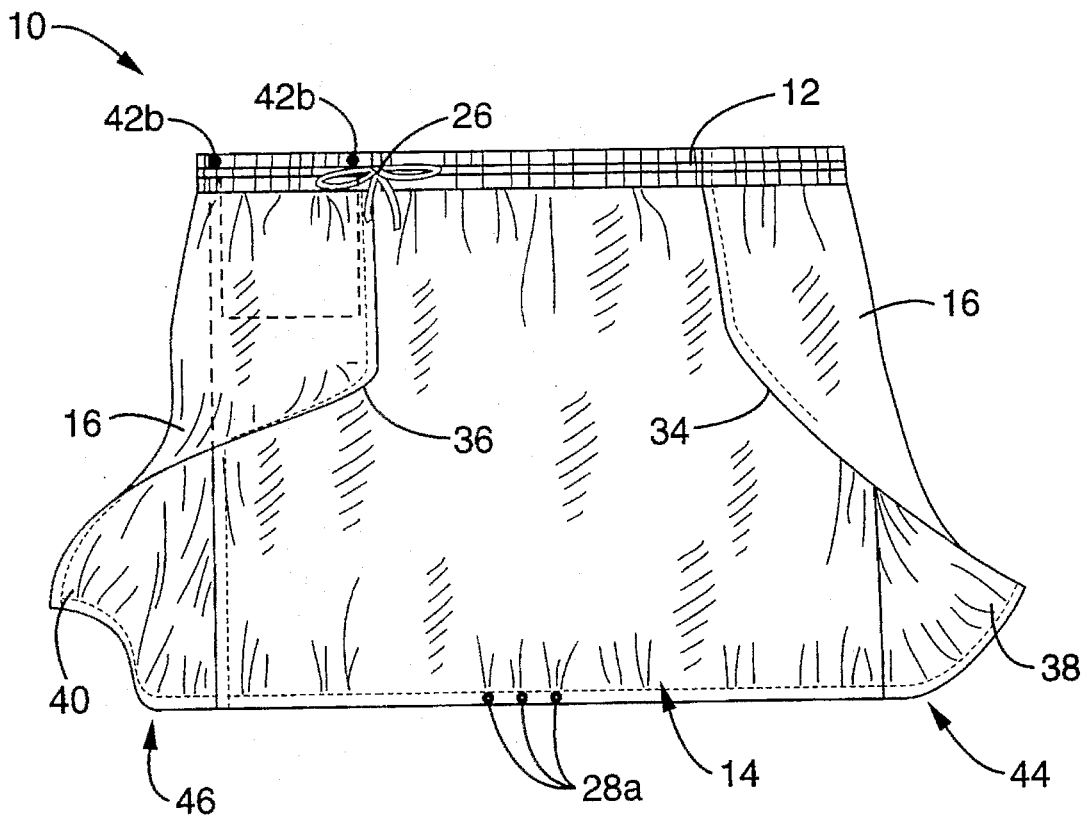
FIG. 6 is a front view of the hospital garment of FIG. 1 shown the overlapping leg flaps pulled away to reveal the vertically oriented slits in the outer leg portion of the garment.

As can be seen in FIG. 3, front panel member 14 and rear panel member 16 are sewn together or otherwise joined only in the area of support means 12, so as to leave a slit or aperture extending from support means 12 to the bottom edge of the panels. Accordingly, a drapeable or wrap-around skirt with an overlapping flap 38 is formed. Flap 40 is formed when first edge 30 of front panel member 14 and second edge 36 of rear panel member 16 are overlapped and the fasteners 42*a*, 42*b* are engaged as can be seen in FIG. 1 and FIG. 2.

Once the garment 10 has been encircled and adjusted about the waist of a wearer, with front 14 and rear 16 panels appropriately positioned as related above, first overlapping flap 38 on rear panel member 16 and first edge 30 on front panel member generally define a an aperture or slit 44 between front and rear panel members 14, 16. Second overlapping flap 40 on rear panel member 16 together with second edge 32 of front panel member similarly form an aperture or slit 46 between front 14 and rear 16 panel members. The apertures, which extend between the waistband the bottom edges of the front and rear panel members, allow physicians, nurses, or other health care personnel to quickly and easily gain access to the wearer's body for medical treatment purposes without requiring adjustment or removal of garment 10.

It will be appreciated that the overlapping flaps 38, 40 may be positioned toward the front or rear of the garment, or at the outermost point on the outside of the leg portion thereof while still achieving essentially the same effect. Further, additional overlapping flaps may be included on both front and rear panel members, to provide greater access for medical personnel. The overlapping flaps 38, 40, provide convenient access for medical personnel, while providing greater coverage and privacy for the wearer which is not available in traditional hospital gowns which open at the back. Traditional hospital garments allow the wearer's behind to protrude out the opening at the back, subjecting the wearer to unpleasant cool breezes and the critical gaze of casual passers-by. The present invention remedies this deficiency, and the privacy of patients wearing the garment 10 is thus generally preserved.

Snap fasteners 28*a*, 28*b* on the bottom ends 20, 24 of front 14 and rear 16 panel members, respectively, can be fastened to each other about the crotch of the wearer to define leg-accommodating openings, 48, 50, thus forming a pant-like arrangement. The snap fasteners 28*a*, 28*b* are positioned along bottom ends 20, 24, of front 14 and rear 16 panel members, respectively, so that catheter tubing, colostomy tubing, or other tubing (not shown) associated with medical treatment may run between the fastened snaps 28*a*, 28*b*. Similarly, wiring or sensors (not shown) associated with medical treatment may be fitted between the fastened snaps 28*a*, 28*b*. The tubing or wiring can be easily changed or altered without removing the garment 10, by unfastening snaps 28*a*, 28*b*. If desired, a pocket 52 can be included for holding medical sensors or instrumentation.

Accordingly, it will be seen that the present invention provides a hospital garment which accommodates tubing and wiring appurtenant to patient treatment, which allows facile access to the patient by health care personnel without removing the garment, and which can be quickly and easily placed on and removed from patients of limited mobility. Although the description above contains many specificities, these should not be construed as limiting the scope of the invention but as merely providing illustrations of some of the presently preferred embodiments of this invention. Thus, the scope of this invention should be determined by the appended claims and their legal equivalents.

I claim:

1. A hospital garment for covering the lower portion of a patient's body, comprising:

(a) a drapeable panel member having top and bottom ends, said panel having a flat structure and configuration;

(b) waist encircling support means for supporting said panel member around a wearer's waist;

(c) a plurality of vertically oriented slit means for providing medical access to a wearer, said slit means extending from said waist encircling support means to said bottom end of said panel member;

(d) a plurality of overlapping flaps, one said flap covering each said slit means; and (e) fastening means adjacent said bottom end of said panel member for providing medical access to said patient adjacent the crotch of said patient.

2. A hospital garment as recited in claim 1, wherein said waist encircling means includes first and second ends, and further includes means for overlapping and fastening said first and second ends.

3. A hospital garment for covering the lower portion of a patient's body, comprising:

(a) waist encircling means for encircling a wearer's waist;

(b) a drapeable front panel member of flat structure and configuration, said front panel member depending from said waist encircling means, said front panel member having a top and bottom end;

(c) a drapeable rear panel member of flat structure and configuration, said rear panel member depending from said waist encircling means, said rear panel member having a top and bottom end, (d) a plurality of vertically oriented slit means for providing medical access to a wearer, each said slit means extending from said waist encircling means to said bottom ends of said panel members;

(e) a plurality of overlapping flap means for providing privacy to a wearer, each said flap means covering a corresponding one of said slit means; and (f) fastening means for providing medical access to a wearer adjacent the wearer's crotch, said fastening means positioned adjacent said bottom end of said front panel member and said bottom end of said rear panel member.

4. A hospital garment as recited in claim 3, wherein said waist encircling means includes means for circumferentially adjusting said waist encircling means.

5. A hospital garment as recited in claim 4, wherein said means for circumferentially adjusting said waist encircling means comprises a drawstring.

6. A hospital garment as recited in claim 5, wherein said means for circumferentially adjusting said waist encircling means further comprises a plurality of fasteners.

7. A hospital garment as recited in claim 6, wherein said means for circumferentially adjusting said waist encircling means further comprises elastic.

8. A hospital garment for covering the lower portion of a patient's body, comprising:

(a) a waistband, said waistband including means for circumferentially adjusting said waistband to fit the waist size of a wearer;

(b) a drapeable front panel member of flat structure and configuration, said front panel member including a top end and a bottom end, said front panel member joined to and extending from said waistband at said top (c) a drapeable rear panel member of flat structure and configuration, said rear panel member including a top end and a bottom end, said rear panel member joined to and extending from said waistband at said top end;

(d) first and second vertically oriented slit means for providing medical access to a wearer, said slit means located between said front and rear panel members, each said slit means extending from said waistband to said bottom ends of said front and rear panel members;

(e) said rear panel member including first and second flap means for providing privacy to a wearer, said first and second flap means partly overlapping said front panel member, said first flap means covering said first slit means, said second flap means covering said second slit means; and (f) a plurality of fastening means for providing medical access to a wearer adjacent the wearer's crotch, said plurality of fastening means located adjacent said bottom ends of said front and rear panel members, said plurality of fastening means positioned to allow catheter and colostomy tubing to fit between individual said fastening means.

9. A hospital garment as recited in claim 8, wherein said front panel member includes first and second edges, said rear panel member includes first and second edges, said first edge of said rear panel member overlaps said first edge of said front panel member so as to define said first flap means, and said second edge of said rear panel member overlaps said second edge of said front panel member so as to define said second flap means.

10. A hospital garment as recited in claim 9, wherein said means for circumferentially adjusting said waistband comprises a drawstring.

11. A hospital garment as recited in claim 10, wherein said means for circumferentially adjusting said waistband further comprises a plurality of fasteners.

12. A hospital garment as recited in claim 11, wherein said means for circumferentially adjusting said waist encircling means further comprises elastic.

* * * * *